US009051776B2

(12) United States Patent
Wessel

(10) Patent No.: US 9,051,776 B2
(45) Date of Patent: Jun. 9, 2015

(54) APPARATUS AND METHOD FOR SOLAR HEAT GAIN REDUCTION IN A WINDOW ASSEMBLY

(71) Applicant: Robert B. Wessel, New York, NY (US)

(72) Inventor: Robert B. Wessel, New York, NY (US)

(73) Assignee: Robert B. Wessel, New York, NY (US)

( * ) Notice: Subject to any disclaimer, the term of this patent is extended or adjusted under 35 U.S.C. 154(b) by 0 days.

(21) Appl. No.: 14/247,980

(22) Filed: Apr. 8, 2014

(65) Prior Publication Data

US 2014/0265021 A1 Sep. 18, 2014

Related U.S. Application Data

(63) Continuation of application No. 12/908,819, filed on Oct. 20, 2010, now abandoned.

(51) Int. Cl.

| | |
|---|---|
| ***E06B 7/28*** | (2006.01) |
| ***E06B 3/673*** | (2006.01) |
| ***E06B 9/264*** | (2006.01) |
| ***E06B 3/66*** | (2006.01) |
| ***E06B 3/663*** | (2006.01) |

(52) U.S. Cl.

CPC ..... *E06B 3/673* (2013.01); *E06B 9/264* (2013.01); *E06B 3/66* (2013.01); *E06B 3/663* (2013.01)

(58) Field of Classification Search

USPC ..... 49/61, 62, 63, 64, 74.1, 507, 506, 92.1; 160/236; 52/786.11

See application file for complete search history.

(56) References Cited

U.S. PATENT DOCUMENTS

| | | | | | |
|---|---|---|---|---|---|
| 737,979 | A | * | 9/1903 | Wadsworth | 359/594 |
| 2,689,387 | A | * | 9/1954 | Carr | 160/90 |
| 2,749,794 | A | * | 6/1956 | O'Leary | 359/599 |
| 2,976,583 | A | * | 3/1961 | McCarthy | 52/402 |
| 3,324,620 | A | * | 6/1967 | Requena | 52/786.11 |
| 3,438,699 | A | * | 4/1969 | Seeger | 359/596 |
| 3,444,031 | A | * | 5/1969 | Schrenk | 428/114 |
| 3,642,557 | A | * | 2/1972 | Warp | 359/596 |
| 3,756,703 | A | * | 9/1973 | Nelson | 351/45 |
| 3,940,896 | A | * | 3/1976 | Steel | 52/307 |
| 4,091,592 | A | * | 5/1978 | Berlad et al. | 52/786.1 |
| 4,141,185 | A | * | 2/1979 | Keith | 52/171.3 |
| 4,245,435 | A | * | 1/1981 | Ulbricht | 49/64 |
| 4,245,620 | A | * | 1/1981 | Heinemann | 126/662 |
| 4,262,659 | A | * | 4/1981 | Brzezinski | 126/667 |
| 4,279,240 | A | * | 7/1981 | Artusy | 126/579 |
| 4,411,493 | A | * | 10/1983 | Miller | 359/595 |
| 4,505,069 | A | * | 3/1985 | Freeman | 49/64 |
| 4,509,825 | A | * | 4/1985 | Otto et al. | 359/592 |
| 4,611,648 | A | * | 9/1986 | Anderson | 160/107 |
| 4,653,797 | A | * | 3/1987 | Tran | 296/152 |
| 4,688,156 | A | * | 8/1987 | Suzuki et al. | 362/354 |

(Continued)

*Primary Examiner* — Katherine Mitchell
*Assistant Examiner* — Justin Rephann
(74) *Attorney, Agent, or Firm* — Booth Albanesi Schroeder LLC

(57) ABSTRACT

A window assembly having at least one pane is presented for use in a building. Positioned within the pane are a plurality of spaced-apart micro-louvers which extend substantially across the length of the pane. The micro-louvers are positioned to block transmission of direct sunlight through the pane when the sun is at a selected angle above the horizon or higher. The angle at and above which direct light is blocked can be selected to be approximately 30 or 45 degrees above the horizon, for example. The angle can be selected based on the latitude of the location of the window assembly, the time of day during which direct sunlight is blocked, etc. The micro-louvers may have reflective surfaces, be colored as desired, be opaque or translucent.

22 Claims, 6 Drawing Sheets

(56) References Cited

U.S. PATENT DOCUMENTS

| | | | | | |
|---|---|---|---|---|---|
| 4,702,296 | A * | 10/1987 | Anderson | 160/107 |
| 4,746,192 | A * | 5/1988 | Minagawa | 359/576 |
| 4,772,097 | A * | 9/1988 | Takeuchi et al. | 359/894 |
| 4,813,198 | A * | 3/1989 | Johnston et al. | 52/171.3 |
| 4,989,952 | A * | 2/1991 | Edmonds | 359/592 |
| 4,997,687 | A * | 3/1991 | Carter | 428/34 |
| 5,009,044 | A * | 4/1991 | Baughman et al. | 52/171.3 |
| 5,118,532 | A * | 6/1992 | Batson et al. | 427/278 |
| 5,139,850 | A * | 8/1992 | Clarke et al. | 428/192 |
| 5,147,716 | A * | 9/1992 | Bellus | 428/323 |
| 5,850,861 | A * | 12/1998 | Silverberg | 160/107 |
| 5,880,886 | A * | 3/1999 | Milner | 359/599 |
| 6,002,511 | A * | 12/1999 | Varaprasad et al. | 359/265 |
| 6,105,318 | A * | 8/2000 | Harrison | 52/200 |
| 6,230,453 | B1 * | 5/2001 | Alden | 52/171.3 |
| 6,239,911 | B1 * | 5/2001 | Koike et al. | 359/601 |
| 6,424,406 | B1 * | 7/2002 | Mueller et al. | 359/613 |
| 6,467,935 | B1 * | 10/2002 | Schwab | 362/354 |
| 6,478,072 | B1 * | 11/2002 | Allman | 160/89 |
| 6,550,937 | B2 * | 4/2003 | Glass | 362/290 |
| 6,551,715 | B1 * | 4/2003 | Seto et al. | 428/432 |
| 6,568,310 | B2 * | 5/2003 | Morgan | 89/36.02 |
| 6,580,559 | B2 * | 6/2003 | Doll et al. | 359/591 |
| 6,905,219 | B2 * | 6/2005 | Gaides | 362/23 |
| 7,070,314 | B2 * | 7/2006 | Edmonds | 362/600 |
| 7,481,957 | B1 * | 1/2009 | Adickes | 264/261 |
| 2003/0080248 | A1 * | 5/2003 | Morgan | 244/118.5 |
| 2005/0073756 | A1 * | 4/2005 | Poulsen | 359/861 |
| 2005/0232530 | A1 * | 10/2005 | Kekas | 385/11 |
| 2006/0070300 | A1 * | 4/2006 | Gabriele | 49/403 |
| 2008/0080040 | A1 * | 4/2008 | Mimura et al. | 359/238 |
| 2008/0088905 | A1 * | 4/2008 | Mimura et al. | 359/227 |
| 2008/0089068 | A1 * | 4/2008 | Mimura et al. | 362/292 |
| 2008/0144179 | A1 * | 6/2008 | Mimura et al. | 359/599 |
| 2009/0009861 | A1 * | 1/2009 | Hyobu | 359/456 |
| 2009/0296188 | A1 * | 12/2009 | Jain et al. | 359/245 |
| 2012/0087011 | A1 * | 4/2012 | Moon et al. | 359/601 |
| 2012/0099189 | A1 * | 4/2012 | Bezzel et al. | 359/361 |

* cited by examiner

APPARATUS AND METHOD FOR SOLAR HEAT GAIN REDUCTION IN A WINDOW ASSEMBLY

CROSS-REFERENCE TO RELATED APPLICATIONS

This patent application is a continuation of U.S. application Ser. No. 12/908,819, filed Oct. 20, 2010, which is hereby incorporated by reference in its entirety for all purposes, and claims priority to U.S. Provisional App. No. 61/279,424, filed Oct. 20, 2009.

FIELD OF INVENTION

The invention relates generally to solar heat gain reduction in window assemblies, and more specifically to an assembly and method to reduce solar heat gain in a window assembly by utilization of micro-louvers positioned in a window pane which block direct sunlight when the sun is at a preselected angle above the horizon and higher.

BACKGROUND OF INVENTION

There are three causes of Solar Heat Gain (SHG), namely, ultraviolet (UV) and infrared (IR) radiation and direct sunlight. Films have been successful in all but eliminating SHG due to UV and IR radiation. Problems remain in significantly reducing SHG due to direct sun light. To reduce the energy loss required to cool building interiors, some building codes have begun requiring a minimum SHG Coefficient (SHGC) of 0.40 in the windows, and/or the reduction of the size and/or amount of windows, especially on south facing facades, in an attempt to reduce the energy needed for cooling or counteracting the effects of SHG.

Currently, to reach these new standards of SHGC, windows, in addition to being insulated, are often either tinted, reflective, or both. Both of these solutions reduce light transmission through the window, and can reduce visibility, in a range from about 47% to as much as 90%, creating darker interiors, requiring artificial lighting, and, in a way, defeating the purpose and counteracting, at least to some extent, the savings realized in reduced energy cooling costs. This invention is intended to have minimal impact on visible light transmission, thereby reducing the need for interior lighting to counteract a reduction in visible light transmission, while still dramatically reducing SHG.

Architects have used obstruction designs (walls, overhangs, balconies, etc.) in an attempt to block the direct, heating rays of the sun. These solutions have limitations and they limit or block sight lines and views. Venetian blinds are also an attempt to create shading through obstruction, but they are ineffective in reducing SHG between the window and the blinds, causing radiant heat within the space.

SUMMARY

A window assembly for use in a building is presented. The window assembly has a pane of material. Positioned within the pane are a plurality of spaced-apart micro-louvers which extend substantially across the length of the pane. The micro-louvers are positioned to block transmission of direct sunlight through the pane when the sun is at a selected angle above the horizon or higher. In one embodiment, the micro-louvers are oriented horizontally. The angle at and above which direct light is blocked can be selected to be approximately 30 or 45 degrees above the horizon, for example. The angle can be selected based on the latitude of the location of the window assembly, the time of day during which direct sunlight is blocked, etc. In one embodiment, the micro-louvers are rectangular in cross-section, although other shapes may be used. In one embodiment, the micro-louvers have at least one reflective surface. The micro-louvers may also be partially or completely colored as desired. Additional panes may be used as well. In a preferred embodiment, the micro-louvers are opaque, providing complete blockage of direct sunlight. In alternate embodiments, the micro-louvers are translucent, providing a selected level of opacity.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

For ease of understanding, like numbers are used for like parts throughout the drawings.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not delimit the scope of the present invention.

As used herein, the terms "direct light" or "direct sunlight" refer to direct light in the visible spectrum from the sun. That is, radiation emitted from the sun in the visible spectrum which proceeds in a line to, or is on a line-of-sight with, the object on which it shines. When referring to "direct light" which has been transmitted through a window pane or panes, it is understood that the "direct light" undergoes minor refraction as it passes through the pane or panes. However, the light is still referred to as "direct light" shining on the object after transmission through the window pane or panes. In common parlance, an object is in "direct light" or "shade." "Direct light" does not include ambient or reflected light.

As used herein, the terms "ambient light" or "ambient sunlight" refers to indirect sunlight or sunlight reflected off a surface. "Ambient light" is used to distinguish from "direct light." An object lit by ambient light (and not direct light) may be thought of as being in the shade.

As used herein the term "visible light" refers to radiation in the visible light spectrum. Similarly, the terms infrared (IR) and ultraviolet (UV) refer to radiation in those spectrums.

Figure 1:
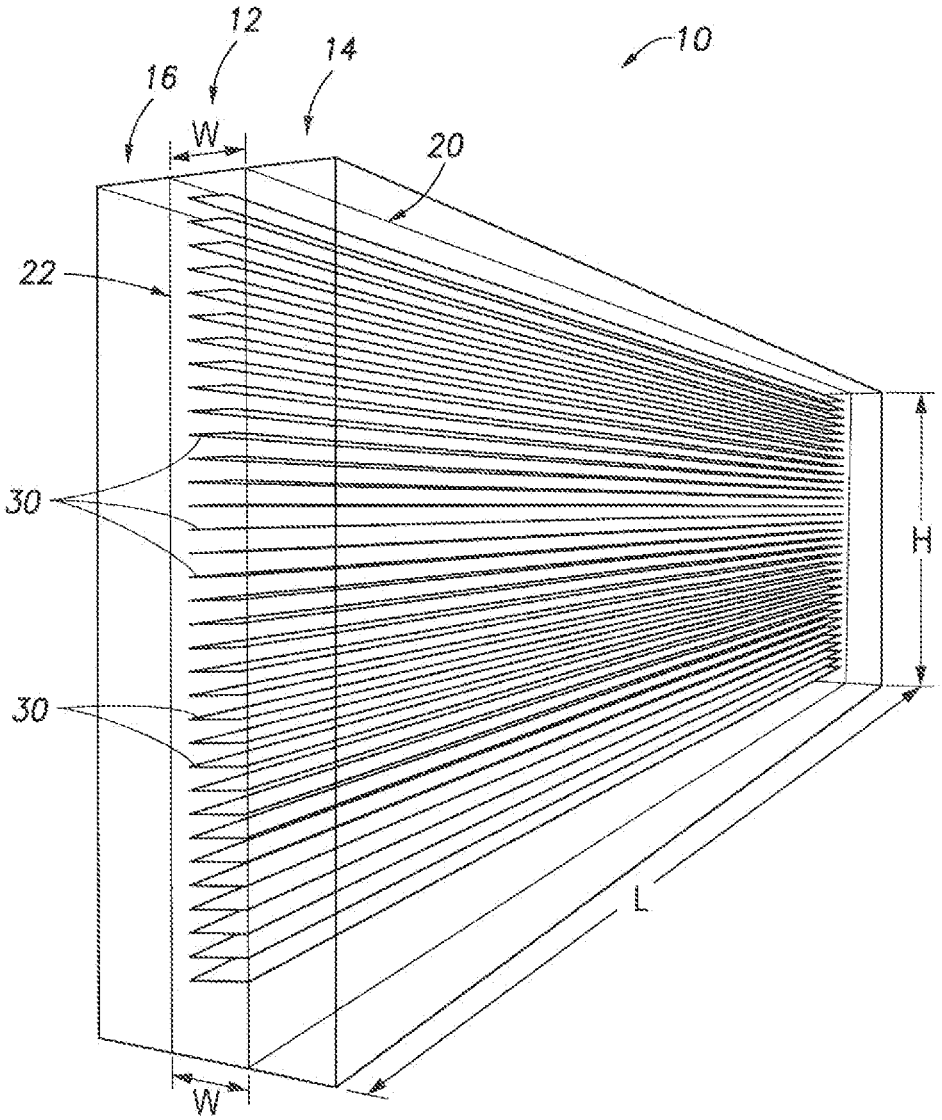
FIG. 1 is an orthogonal representational view of a window assembly 10 according to one aspect of the invention.

FIG. 1 is an orthogonal representational view of a window assembly 10 according to one aspect of the invention. A window assembly 10 having multiple window panes 12, 14 and 16 is shown. The window panes 12, 14 and 16 may be made of any material typically used in building construction which allows the transmission of visible light. The material may be glass, plastic, acrylic, resin, or other material known in the art. The window assembly may further include framing structures, films, adhesives and bonding materials (not shown). The window assembly 10 can have a single pane 12, or, as shown, multiple panes in various arrangements. In a preferred embodiment, a pane 14 and a pane 16 are positioned on either side of the pane 12 and abut the pane 12. Further, the panes can be positioned such that gaps separate the panes. For example, this would allow for double-paned insulated windows and for additional energy efficient measures such as argon gas layers. Further, additional layers can be added, such as films or screens, such as UV films and IR films. Abutting panes can be attached to one another by adhesive or other chemical bond; adjacent panes can be attached to one another mechanically, such as by a frame (not shown), or by any manner known in the art.

Figure 2:
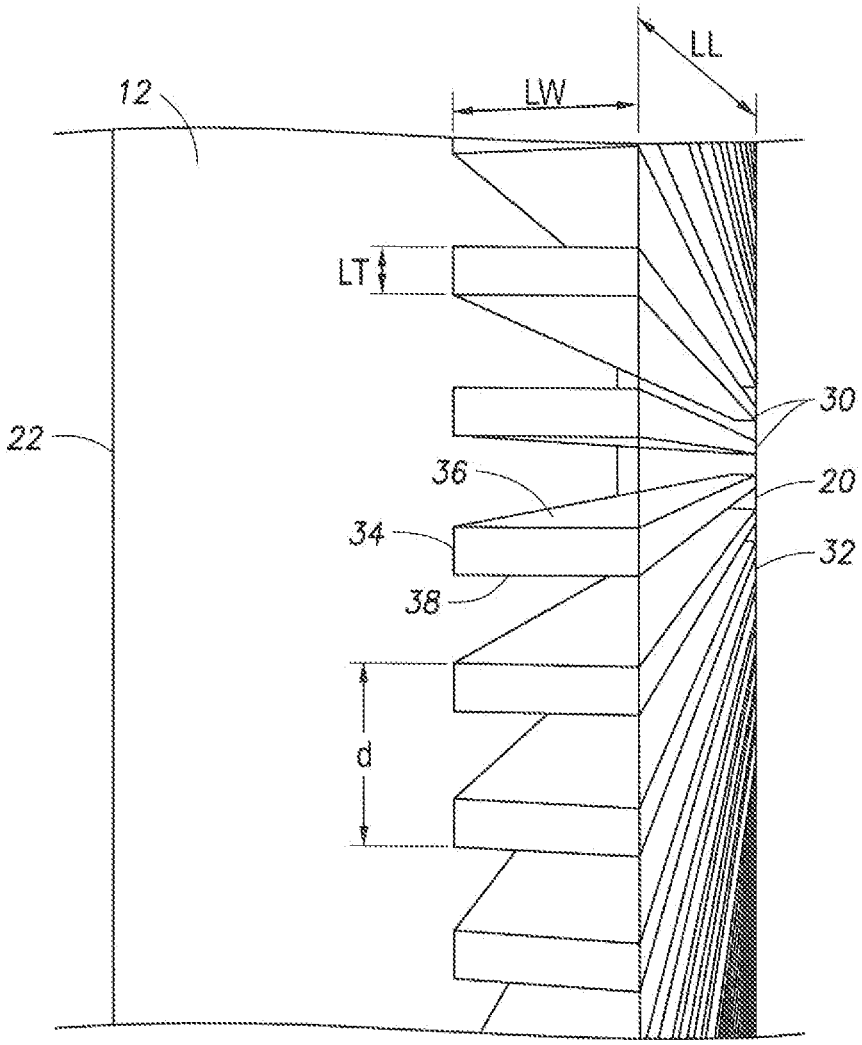
FIG. 2 is a partial orthogonal view of pane 12 exemplifying one embodiment of the invention.
Figure 3:
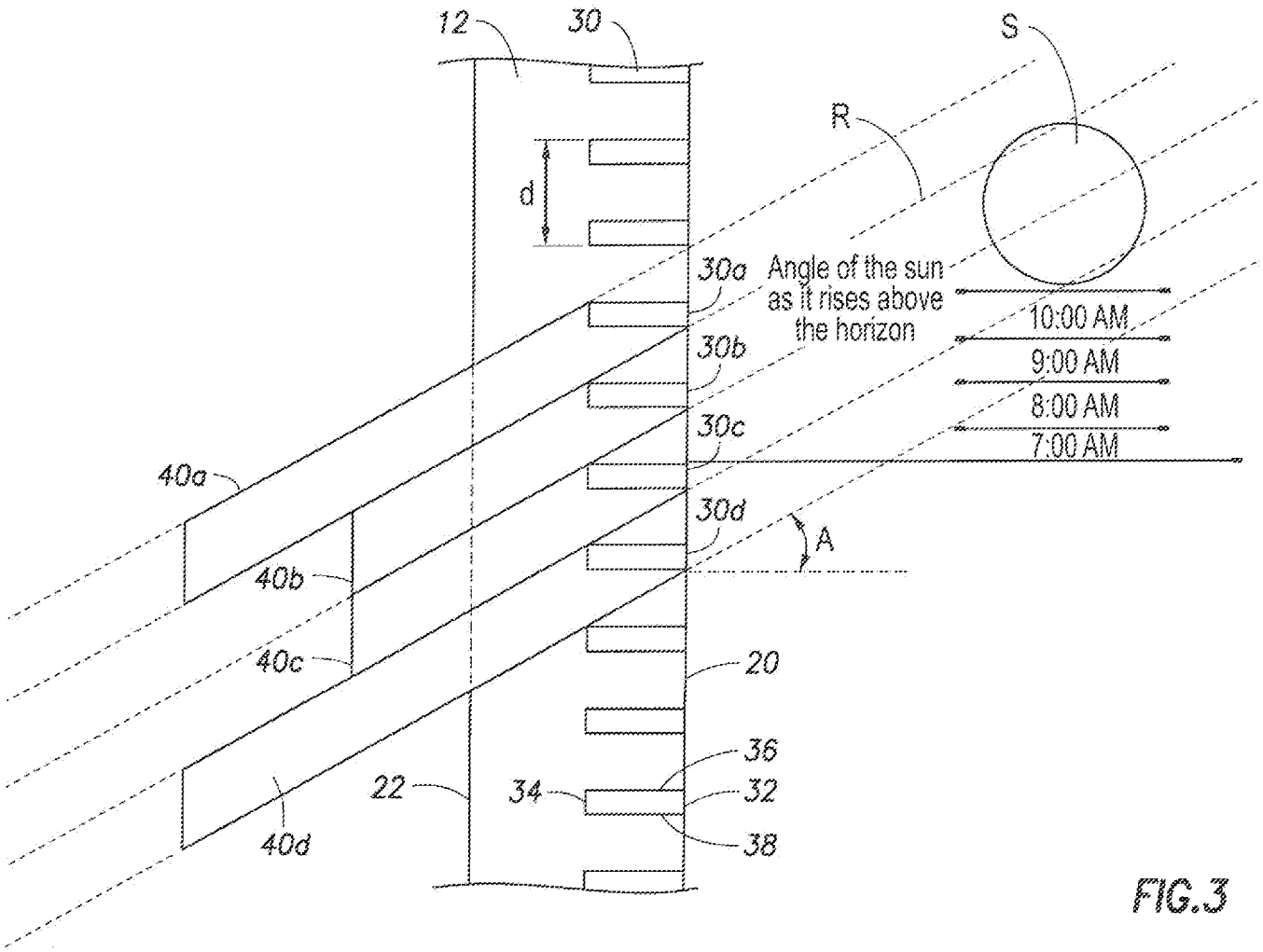
FIG. 3 is a cross-sectional view of the window pane 12 shown in FIG. 2 and exemplifying one embodiment of the invention.

FIG. 2 is an orthogonal view of pane 12 exemplifying one embodiment of the invention. Similarly, FIG. 3 is a cross-sectional view of a window pane 12 exemplifying one embodiment of the invention. Reference to the Figures is made with like parts having like numbers throughout.

Window pane 12 has a front face 20 and a rear face 22, and has a length L, height H, and width W, as shown. Positioned in the pane 12 are a plurality of micro-louvers 30. The micro-louvers 30 extend along the length L of the pane 12. The micro-louvers 30 preferably extend along substantially the entire length of the pane, as shown. The micro-louvers 30 preferably extend parallel to one another, as shown. The micro-louvers 30 are stationary within the pane 12.

Each micro-louver 30 has a length LL, width LW, and thickness LT, as shown in FIG. 2. The micro-louvers 30 are spaced-apart from adjacent micro-louvers by a distance d. Further, each micro-louver has, in the exemplary embodiments shown here, a front surface 32, a rear surface 34, a top surface 36 and a bottom surface 38. In the embodiment seen in FIGS. 1-3, the micro-louvers are rectangular in cross-section. Alternate shapes of micro-louver may be utilized, such as cylindrical, substantially rectangular, etc. Regardless of cross-sectional shape, each micro-louver has an effective length, width and thickness, which determine the shadow cast by the micro-louver. The effective width, length and thickness of the micro-louvers, as well as their orientation (horizontal, etc.), will determine the positioning and spacing requirements for the micro-louvers to provide the desired direct light blockage.

The micro-louvers 30 are most effective, blocking the most direct light, when opaque. The micro-louvers are designed to block transmission of rays R of direct sunlight from the sun S. The micro-louvers 30 can be made of any material that will effectively block transmission of sunlight. For example, the micro-louvers can be made of plastic, resin, rubber, colored glass, or other material. Materials found to be effective include vinyl and polypropylene. Some materials will block sunlight transmission a desired amount only when of a sufficient thickness, requiring the micro-louvers to be made of a minimum thickness. The micro-louvers can be made of material which substantially absorbs the direct sunlight, or can be made of a reflective material. The material choice will affect the amount of ambient light that transmits through the pane and window assembly.

An exemplary range of thickness for the micro-louvers is 0.0001 to 0.0300 inches. For point of reference a sheet of paper is typically 0.004 inches. Thinner micro-louvers are desirable as they reduce the visibility of the micro-louvers to the viewer when seen edge-on. However, at the lower end of the range, it may be difficult to achieve the desired degree of opacity, maintain physical integrity during manufacturing, maintain UV stability during use, etc. Consequently, in testing, it has been found that a thickness of approximately 0.001 to 0.003 inches is effective.

An exemplary range of width LW for the micro-louvers is 1/64 to 1/8 inch. Based on testing, an optimum range is about 1/32 inch to 1/16 inch in width LW. While wider micro-louvers are possible, at some point increased width LW results in a necessary increase in width W of the pane 12, which is typically undesirable. Further, the wider the micro-louvers, the more prominent they become to a viewer, even at small angles of view with respect to the angle of orientation of the micro-louver. At narrower widths, for example at less than 1/64 of an inch, it is more difficult to handle the micro-louver material during manufacturing, damage may occur to the micro-louvers, etc. Further, at such extremely narrow widths, the spacing distance, d, between the micro-louvers becomes extremely small to achieve complete shading. For practical matters, it becomes difficult to provide consistent spacing where the spacing distance is less than 1/128 of an inch. Further, at such small spacing, optical effects become an issue.

The micro-louvers can be made of reflective material or have one or more reflective surfaces. For example, the micro-louvers can be made of metal, mylar (trademark), a mirrored material, etc. Preferably the micro-louvers, if reflective, are made of mylar (trademark) film or foil. Further, reflective surfaces may be desired for aesthetic reasons, either for the view provided to a viewer interior or exterior to the building in which the window assembly is installed. Where reflective material is used for the micro-louvers, sunlight and heat radiation will be reflected and transmitted through the pane. Such an effect may be desired, such as in northern climates, or along an eastern wall, where increased or maximized heat is desired in the interior of the building. In such an embodiment, the sunlight striking the micro-louvers is reflected into the building from the moment sun is over horizon. After the sun reaches the selected angle above the horizon, direct light is blocked but reflective light still transmits through the pane. Consequently, it is possible to block direct light while maximizing reflected light passing through the window pane. The reflectivity of the micro-louvers increases the amount of reflected light transmitting through the pane, as compared to a material which absorbs light.

A practitioner will recognize that the invention has applications in conjunction with solar heat collectors, where the reflective micro-louvers increase the effectiveness of the solar heat collector.

As seen in FIGS. 2 and 3, the micro-louvers 30 are positioned in the pane 12, but the front micro-louver surface 32 is coincident with the front face 20 of the pane 12. Alternately, the micro-louvers 30 can be suspended or embedded within the pane 12 such that the micro-louvers are surrounded by the material of the pane 12, as seen in FIG. 1. Further, the micro-louvers 30 can be positioned within the pane 12 such that more than one surface (such as the front surface 32 and rear surface 34) are coincident with faces of the pane 12 (such as faces 20 and 22, respectively). Where the pane 12 is the only pane in the window assembly, as seen in FIGS. 2 and 3, one or more surfaces of the micro-louvers may be exposed to the air.

The micro-louvers 30 are positioned in the pane 12 to block transmission of direct sunlight through the pane when the sun is at a selected angle above the horizon or higher.

FIG. 3 shows the sun S emitting radiation rays R of sunlight. The sun is at an angle above the horizon, A, sometimes referred to as the solar altitude angle. Obviously, the angle above the horizon increases as the sun rises during the course of a day, and decreases after the sun reaches its highest point, or zenith, and sets.

The positioning, spacing, and size of the micro-louvers is selected to block the transmission of direct sunlight through the pane 12 when the sun is at a selected angle above the horizon or higher. Conversely, direct sunlight is transmitted through the pane when the sun is at an angle above the horizon less than the selected angle.

For example, if it is desired to block direct sunlight when the sun is at an angle of 30 degrees or higher above the horizon, the micro-louvers 30 can be oriented horizontally, as shown, and be 1/16 inch wide and spaced-apart by 1/32 inch. In such a case, the micro-louvers cast a shadow, or create shade, 40, on the side of the pane 12 opposite the sun, eliminating transmission of direct sunlight. The shaded areas seen in FIG. 3 indicate the shade created by the micro-louvers. Micro-louvers 30*a-d* creates shaded areas 40*a-d*, respectively. When the sun is below the selected angle above the horizon, direct light will transmit through the pane in the spaces between adjacent micro-louvers. As the sun moves to an angle above the horizon closer to the selected angle, less direct sunlight will transmit through the pane and a greater area of shadow will be created. When the sun reaches the selected angle (and higher), the micro-louvers block all direct sunlight, leaving the interior of the room completely in shade. At the selected angle above the horizon, the shaded areas 40*a-d* abuts one another, thereby completely shading the interior of the room along the length of the micro-louvers.

Alternate widths and spacing will be apparent to those of skill in the art for any selected angle above the horizon desired. For example, the micro-louvers 30 can be 0.02 inches wide and spaced apart by a distance, d, of 0.03 inches and block direct sunlight when the sun is at an angle of 30 degrees above the horizon or greater. The micro-louvers 30 will continue to block direct sunlight as the sun rises to greater angles above the horizon. Direct sunlight will be transmitted through the pane 12, through the spaces between micro-louvers 30 when the sun sinks to below an angle of 30 degrees above the horizon in the afternoon or evening.

As another example, the window assembly 10 can be designed to block transmission of direct sunlight when the sun is at or above an angle above the horizon of 45 degrees. In such as case, the micro-louvers 30 will have the same width LW and spacing or distance d between micro-louvers (assuming the micro-louvers are horizontal). For example, the micro-louvers 30 can be 1/16 inch wide and spaced apart a distance of 1/16 inch, or be 1/32 inch wide and spaced 1/32 inch apart.

The examples given are for purposes of illustration; other widths and spacing will be apparent to those of skill in the art.

The selected angle above the horizon of the sun will correspond to a time or times of the day. For example, the sun may reach 30 degrees above the horizon in the morning, (for example, at 10 a.m.), and then sink back below 30 degrees in the afternoon (at 6 p.m. for example). Consequently, the width and spacing of the micro-louvers can be selected to block direct sunlight during certain times of the day. Obviously, these times will change as the seasons change, since the solar altitude angle of the sun will differ at similar times of the day.

Further, the angle above the horizon of the sun will reach a selected angle above the horizon at different times of the day depending on the latitude of the window assembly. For example, at a latitude of approximately 35N, the sun, on or about the summer solstice, will pass 30 degrees above the horizon at approximately 9:45 a.m. and sink back below 30 degrees at approximately 6:30 p.m. At latitude of approximately 15N, the sun will pass through 30 degrees above the horizon at approximately 10 a.m. and 6:15 p.m. Consequently, the width and spacing of the micro-louvers can be selected based on a target time or times when it is desired to block direct sunlight. (The times of day will change as the seasons change; the examples given are approximate and for summer solstice.)

The degree of angle above the horizon at which the micro-louvers completely block transmission of sunlight, or the times of day when blocking direct light is desired, can be selected based on considerations of desired periods of shade, periods of light, desired SHG reduction or SHGC, etc.

The degree to which the micro-louvers 30 will block direct sunlight depends on the opacity level of the micro-louvers. In a preferred embodiment, the micro-louvers are opaque, that is, having an opacity level of 100. Alternately, the micro-louvers can be translucent, having an opacity level in the range of 1-99. Opaque micro-louvers are the most effective for blocking light and reducing SHG. However, translucent material may be used. This would reduce the effectiveness of the window in reducing SHG, but increase the amount of light transmitted through the pane into the space. For example, opaque micro-louvers can be employed on the south facing side of a building while translucent micro-louvers are utilized on the other faces of the building. Further, where a target SHGC is in view, it may not be necessary to use opaque micro-louvers to achieve the targeted SHGC.

The micro-louvers are designed to be virtually invisible to the naked eye when viewed from an angle of zero degrees with respect to the plane of the micro-louvers. Stated another way, where the micro-louvers 30 are oriented horizontally, when the viewer looks at the window pane 12 at a horizontal angle, the micro-louvers tend to virtually disappear as the distance between the viewer and the window increases. If the viewer looks at the pane at an angle to the plane of the micro-louvers, he will, of course, have his view obstructed by the micro-louvers. In a preferred embodiment, the micro-louvers virtually disappear at a distance from the pane of two to three feet, when viewed from an angle coincident with the angle of orientation of the micro-louver.

In the preferred embodiments, the micro-louvers are oriented at a horizontal angle. Further, since most window assemblies and window panes are oriented vertically, the micro-louvers are typically oriented at 90 degrees to the face of the pane. Other arrangements may be desired. The micro-louvers can be angled at other than 90 degrees to the face of the pane. The window pane can be installed at an angle from the vertical, while the micro-louvers are in a horizontal orientation. Further, the micro-louvers may be oriented vertically, or at any other angle, as desired. Where the micro-louvers are positioned vertically, the direct sunlight blocked by the micro-louvers will be dependent on a selected solar angle of azimuth.

The color of the micro-louvers 30 can be selected. The surfaces of the micro-louvers may be of different colors and the micro-louvers may be of a different color. Color has an effect on visibility through the window pane 12 for the viewer. The eye tends to look past black, so the best color for the rear surface 34 of the micro-louvers, which faces the interior of the building, is black. The front surface 32 can also be black for better visibility through the pane for a viewer on the exterior of the building. Color will also affect the appearance of the color of the exterior of the building. The color of the bottom surface 38 of the louvers will be what the public sees as they get closer to the building. For example, where the micro-louvers are selected to block direct light at 30 degrees or higher above the horizon, they will also block line-of-sight viewing of the interior of the building (by a viewer exterior to the building) when he is 30 degrees or more below the plane of the micro-louvers. Consequently, the building windows will appear to be the color of the micro-louvers when viewed from such an angle. Color selection may be an aesthetic choice for architects. This effect also provides for privacy on floors above the ground floor for viewers at a near distance from the building. Further, micro-louvers which are black (or dark) may tend to make the window "disappear" to the viewer against a night sky.

In testing, utilization of the assembly described herein achieved a reduction in solar heat gain of up to 85% while still allowing transmission of visible light of up to 85%. Compare this to currently available window assemblies, such as a double-glaze, low solar heat gain, low-e glass window assembly, which reduces solar heat gain by up to 65% but only allows visible light transmission up to about 30%.

A preferred method of manufacturing involves a simple frame 60 that has narrow (0.003 inch) slots 62, 1/32 inch apart on each side. The 1/16 inch wide vinyl ribbon 64, which will form the micro-louvers, is strung from side to side so as to create the required pattern of parallel micro-louvers. The micro-louver material is held in place while glass panels 66 and 68 are slipped under them and placed on spacers 70 over them. The goal is to create a 1/64 inch gap 82 between the glass panel 66 under the strung micro-louvers and another 1/64 inch gap 84 between the top of the micro-louvers and the top panel of glass 68. Using structural adhesive, a border 72 is created that holds the top panel of glass to the bottom panel of glass. This border is best created near the inside perimeter 74 of the frame. Once the adhesive has hardened there is a hollow space or gap 80 between the two layers of glass. Using standard lamination techniques, cold cure resin is poured into the space, air bubbles are eliminated, and the laminated panel is held flat until the resin is cured. The laminated glass is then removed for from the frame, the edges 78 are sanded and the now 3/8 inch wide window assembly is inserted into an insulated glass unit.

Other manufacturing methods will be apparent to those of skill in the art. Automation, materials, available machinery, and the configuration of the window assembly product will affect the manufacturing process.

Figure 4:
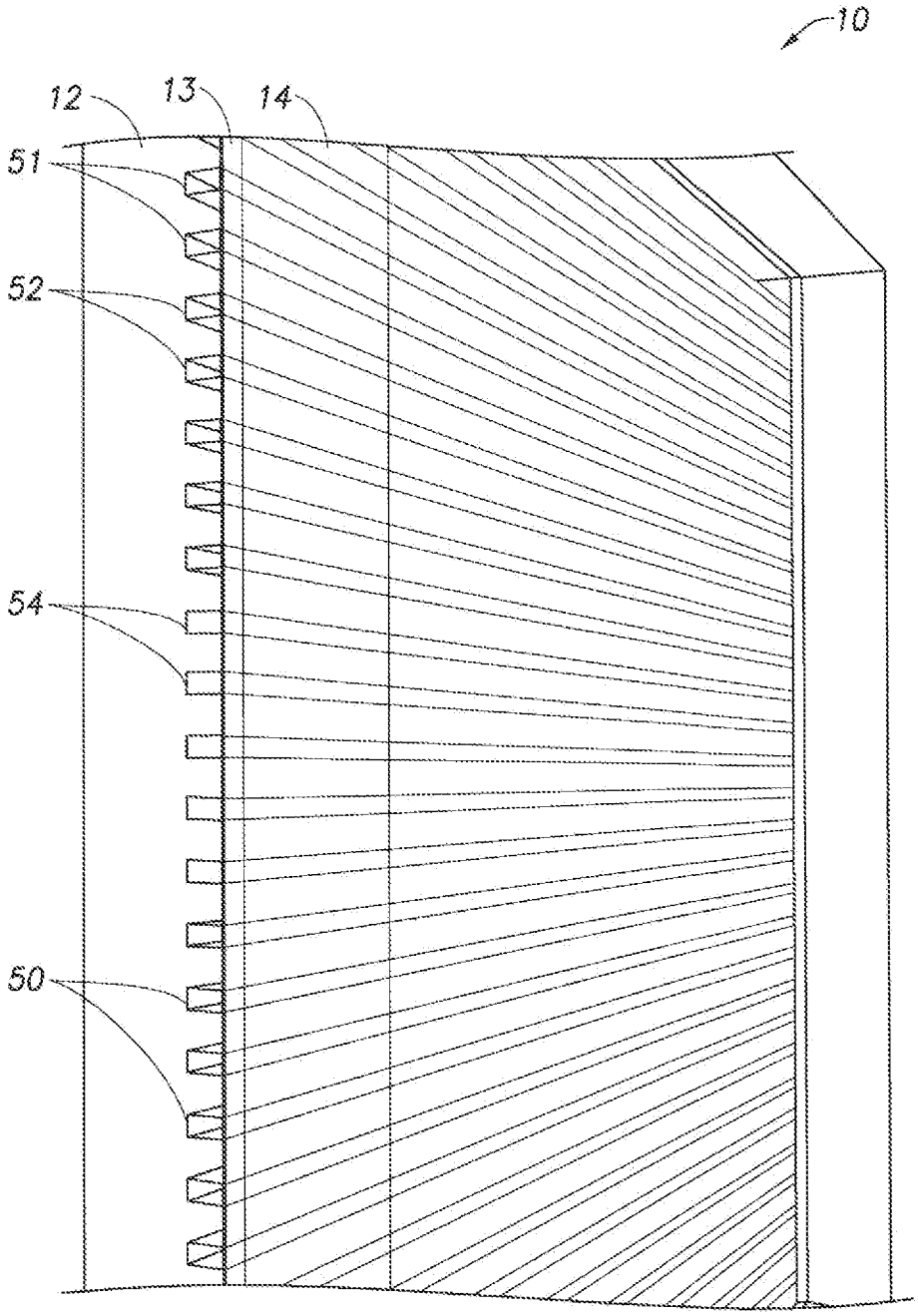
FIG. 4 is a partial orthogonal view of a window assembly having coated or filled channels according to one embodiment of the invention.
Figure 5:
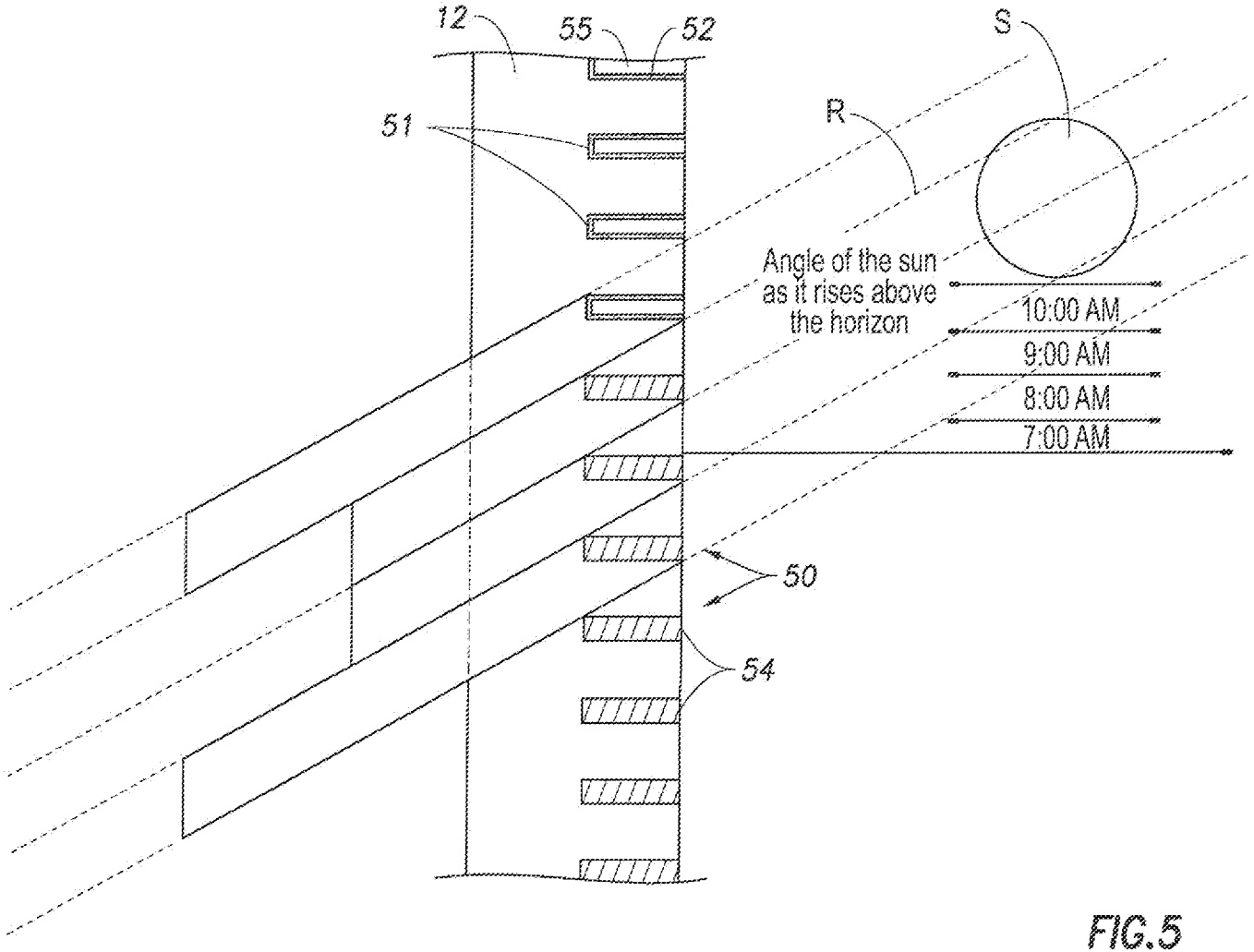
FIG. 5 is a cross-sectional view of a window assembly having coated or filled channels according to one embodiment of the invention.
Figure 6:
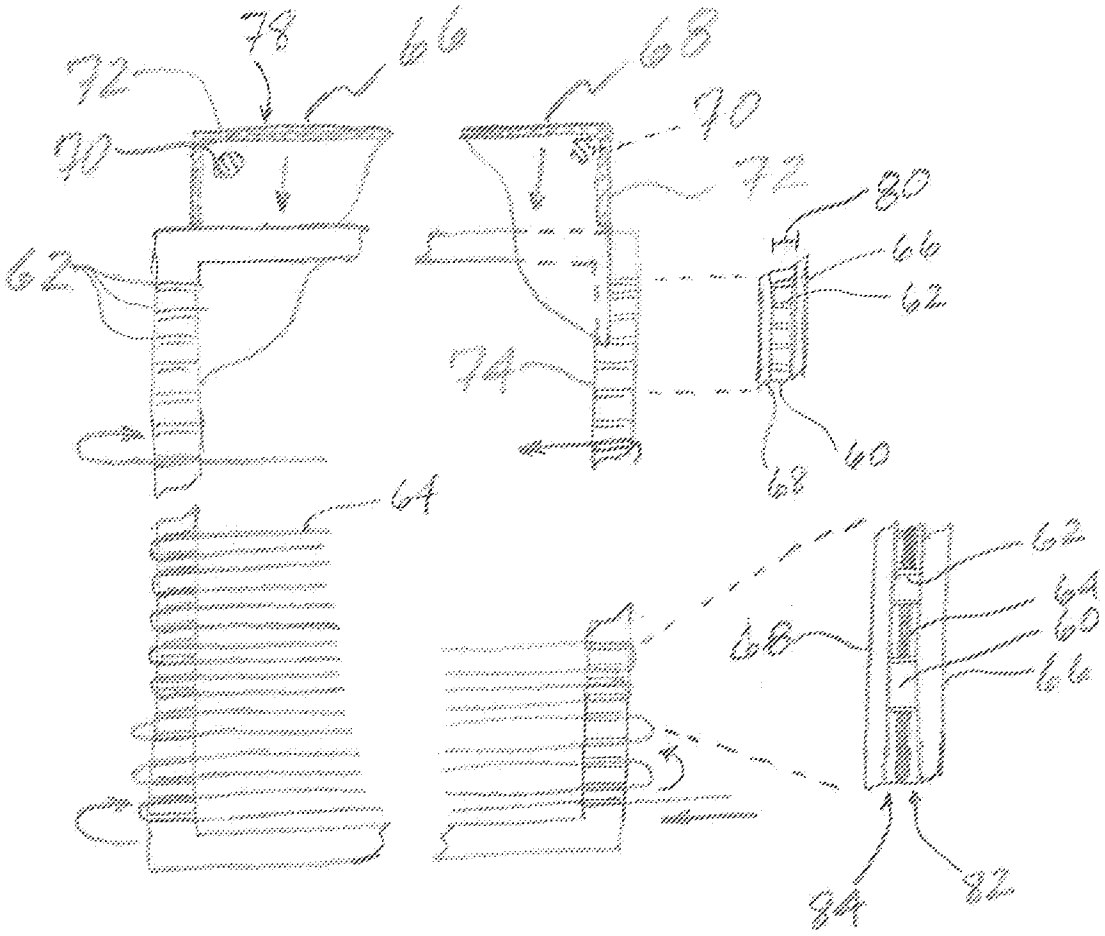
FIG. 6 is a top view with a partial end view and a partial end detail view of a window assembly method according to one embodiment of the invention.

FIGS. 4 and 5 show alternate embodiments of the invention, wherein the pane 12 has channels or indentations which are painted or filled to create micro-louvers 30. FIG. 4 is a partial, orthogonal view of a window assembly according to one embodiment of the invention. FIG. 5 is a cross-sectional view of a window assembly according to one embodiment of the invention.

FIGS. 4 and 5 present pane 12 and adjacent pane 14 with intervening argon-filled gap 13. In pane 12 are a plurality of parallel, spaced-apart channels 50. The channels 50 are shown as U-shaped, with sharp corners, but channels of different shape may be used, such as v-shaped or shallow u-shaped. The channels 50 are then coated or painted with a substance 51 on their interior surface or surfaces 52, such as with a paint that, when dry, provides the desired level of opacity. (Some of the channels 50 are seen in the Figures as coated, some as filled, as hereinafter explained.) The paint substance 51 can be epoxy, enamel, resin, etc. and is preferably a high temperature paint. In FIG. 4, an adjacent pane 14 is positioned abutting the pane 12. In FIG. 5, no extra pane is present.

The channels 50 can be manufactured by any method known in the art. For example, the channels may be etched, ground, molded, etc. Temporary insets may be used and later removed, mechanically, chemically or otherwise. The pane 12 can be of any material, as above, and formed by known methods.

Alternately, the channels 50 can be filled with a fill material 54, as seen in FIGS. 4 and 5 (at some channels). The fill material 54 can be applied by pouring, injection, or other methods known in the art. The fill material 54 can be rubber, plastic, epoxy, enamel or other material. The fill material 54 is selected to provide, after curing, the level of opacity desired for the application. Stated another way, the material 54 both coats the interior surface(s) of the channel and fills the interior space 55 defined by the channel.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of manufacturing a window assembly having a pane of material and a plurality of spaced-apart micro-louvers positioned in the pane of material, the micro-louvers positioned to block transmission of direct sunlight through the pane when the sun is at a selected angle above the horizon or higher, the method comprising:

positioning a first pane of material parallel to and spaced apart from a second pane of material, a gap defined between the first and second panes;

stringing a ribbon of micro-louver material through a plurality of slots defined in a frame, the ribbon forming a pattern defined by a plurality of parallel, spaced-apart micro-louvers extending substantially across the length of the window assembly;

positioning the ribbon of micro-louver material and the first and second panes such that the ribbon of micro-louver material is positioned in the gap defined between the first and second panes;

pouring curing material between the plurality of parallel, spaced-apart micro-louvers;

curing the curing material to create a pane of curing material, the plurality of micro-louvers encased therein, the pane of curing material positioned between the first and second panes.

2. The method of claim 1, wherein the curing material is selected from the group consisting of: glass, plastic, acrylic, resin, and combinations thereof.

3. The method of claim 1, wherein the micro-louver material is vinyl or polypropylene.

4. The method of claim 1, wherein positioning at least one of the first and second panes further comprises positioning at least one of the first and second panes adjacent the frame.

5. The method of claim 4, wherein at least one of the first and second panes is positioned spaced apart from the plurality of micro-louvers.

6. The method of claim 1, further comprising holding the ribbon of micro-louver material in the arranged position while pouring the curing material.

7. The method of claim 1, wherein curing the curing material further comprises cold curing the curing material.

8. The method of claim 1, further comprising eliminating air bubbles in the curing material.

9. The method of claim 1, further comprising adhering at least two of the first and second panes and the cured pane to one another.

10. The method of claim 1, further comprising inserting the first pane and second pane and cured pane into an insulated window assembly.

11. The method of claim 1, further comprising applying films, screens, adhesives, or bonding materials to at least one of the first and second panes or pane of curing material.

12. The method of claim 1, further comprising positioning the micro-louvers to block transmission of direct sunlight through the pane of curing material when the sun is at a selected angle above the horizon or higher and when the pane of curing material is at a selected orientation.

13. The method of claim 1, wherein the ribbon of micro-louver material has a thickness in the range of 0.0001 inches to 0.0500 inches.

14. The method of claim 1, wherein the ribbon of micro-louver material has a thickness in the range of 0.001 inches to 0.003 inches.

15. The method of claim 1, wherein the width of the ribbon of micro-louver material is in the range of 1/32inches to 1/16inches.

16. The method of claim 1, wherein the micro-louvers are reflective or colored.

17. The method of claim 1, wherein the micro-louvers are opaque.

18. The method of claim 1, wherein the micro-louvers are virtually invisible to the naked eye at a distance of three or more feet when viewed at an angle coincident with an angle of orientation of the micro-louvers.

19. The method of claim 1, wherein the window assembly of the micro-louvers encased in the pane of curing material adjacent the first pane of material reduces solar heat gain by at least 65 percent and allows transmission of visible light between 30 and 85 percent.

20. The method of claim 1, wherein positioning the ribbon of micro-louver material and the first and second panes such that the ribbon of micro-louver material is positioned in the gap defined between the first and second panes further comprises positioning the first and second panes adjacent opposite sides of the ribbon of micro-louver material strung in the pattern.

21. The method of claim 20, further comprising creating a border around the first and second panes.

22. A method of manufacturing a window assembly having a pane of material and a plurality of spaced-apart micro-louvers positioned in the pane of material, the micro-louvers positioned to block transmission of direct sunlight through the pane, the method comprising:

arranging a ribbon of micro-louver material on a frame; stringing the ribbon through a plurality of slots defined on the frame; creating a pattern of parallel, spaced-apart micro-louvers extending substantially across the length of the window assembly;

positioning a first pane and a second pane of material parallel to and spaced apart from one another; positioning the strung ribbon in a gap defined between the spaced apart first and second panes;

placing curing material between the plurality of parallel, spaced-apart micro-louvers, substantially filling the spaces between the micro-louvers with the curing material;

substantially filling the gap between the first and second panes with curing material;

curing the curing material to create a cured pane, the plurality of micro-louvers encased therein, the first and second panes on opposing sides of the cured pane.

* * * * *